US011143213B2

(12) United States Patent
Doll et al.

(10) Patent No.: US 11,143,213 B2
(45) Date of Patent: Oct. 12, 2021

(54) APPLICATION-BASED CONTROL OF A VALVE DISK

(71) Applicant: Festo SE & Co. KG, Esslingen (DE)

(72) Inventors: Matthias Doll, Wernau (DE); Rüdiger Neumann, Ostfildern (DE); Stefan Elmer, Pfedelbach (DE); Peter Hofmann, Grafenau-Döffingen (DE); Bernd Schneider, Weil im Schönbuch (DE); Michael Link, Ostfildern (DE)

(73) Assignee: Festo SE & Co. KG, Esslingen (DE)

( * ) Notice: Subject to any disclaimer, the term of this patent is extended or adjusted under 35 U.S.C. 154(b) by 212 days.

(21) Appl. No.: 16/166,083

(22) Filed: Oct. 20, 2018

(65) Prior Publication Data

US 2019/0093681 A1 Mar. 28, 2019

Related U.S. Application Data

(63) Continuation of application No. PCT/EP2017/059270, filed on Apr. 19, 2017.

(30) Foreign Application Priority Data

Apr. 21, 2016 (DE) ..... 10 2016 107 407.1

(51) Int. Cl.
*F15B 13/08* (2006.01)
*F15B 21/08* (2006.01)
(Continued)

(52) U.S. Cl.
CPC ..... *F15B 13/0839* (2013.01); *F15B 13/085* (2013.01); *F15B 13/086* (2013.01);
(Continued)

(58) Field of Classification Search
CPC ..... F15B 13/0839; F15B 13/0867
(Continued)

(56) References Cited

U.S. PATENT DOCUMENTS 5,880,957 A 3/1999 Aardema et al.
7,926,409 B2 4/2011 Arbter et al.
(Continued)

FOREIGN PATENT DOCUMENTS

CN 101275593 A 10/2008
CN 104204554 A 12/2014
(Continued)

OTHER PUBLICATIONS

U.S. Appl. No. 15/968,697, filed May 1, 2018, Matthias Doll.
(Continued)

*Primary Examiner* — Robert A Cassity
(74) *Attorney, Agent, or Firm* — Falk Ewers; Ewers IP Law PLLC

(57) ABSTRACT

An electronic execution unit controls and regulates a pneumatic valve assembly for a pneumatic movement. An application for controlling and regulating a valve assembly is or can be loaded so that it can be carried out on the electronic execution unit to carry out the pneumatic movement on the pneumatic valve assembly. An electronic valve controller for the open-loop control and closed-loop control of a valve assembly has at least one pneumatic valve for a pneumatic movement task.

36 Claims, 9 Drawing Sheets

(51) Int. Cl.
*F15B 11/00* (2006.01)
*F15B 15/20* (2006.01)
*F15B 19/00* (2006.01)

(52) U.S. Cl.
CPC ..... *F15B 13/0867* (2013.01); *F15B 13/0889* (2013.01); *F15B 21/087* (2013.01); *F15B 11/006* (2013.01); *F15B 15/202* (2013.01); *F15B 19/005* (2013.01)

(58) Field of Classification Search
USPC ..... 700/282
See application file for complete search history.

(56) References Cited

U.S. PATENT DOCUMENTS

| | | | | |
|---|---|---|---|---|
| 9,851,019 | B2 | 12/2017 | Shields | |
| 9,886,041 | B2 | 2/2018 | Maichl et al. | |
| 2005/0096756 | A1* | 5/2005 | Quast | F15B 13/0839 700/19 |
| 2006/0240682 | A1 | 10/2006 | Kuhbauch | |
| 2007/0270006 | A1 | 11/2007 | Herges | |
| 2008/0236683 | A1* | 10/2008 | Arbter | F15B 13/085 137/561 R |
| 2009/0234508 | A1* | 9/2009 | Kallfass | E02F 9/2267 700/282 |
| 2013/0327403 | A1 | 12/2013 | Jensen | |
| 2014/0336829 | A1* | 11/2014 | Maichl | G05D 7/0617 700/282 |
| 2014/0379136 | A1* | 12/2014 | Schlegel | B25F 5/00 700/275 |
| 2015/0045971 | A1* | 2/2015 | Endel | F23N 5/184 700/282 |
| 2015/0346733 | A1* | 12/2015 | Yates | G05B 13/0205 700/282 |
| 2016/0098042 | A1* | 4/2016 | Shinkle | G05D 7/0635 700/282 |
| 2018/0245608 | A1 | 8/2018 | Doll et al. | |

FOREIGN PATENT DOCUMENTS

| | | | |
|---|---|---|---|
| DE | 20006295 | U1 | 8/2000 |
| EP | 1710447 | A1 | 10/2006 |
| EP | 1975418 | A1 | 10/2008 |
| JP | 2008516844 | A | 5/2008 |
| WO | 9825189 | A1 | 6/1998 |
| WO | 2006045489 | A1 | 5/2006 |
| WO | 2013107466 | A1 | 7/2013 |
| WO | 2017076430 | A1 | 5/2017 |

OTHER PUBLICATIONS

International Search Report issued in PCT/EP2017/059270, to which this application claims priority, with English-language translation, dated Nov. 21, 2017.
Written Opinion issued in PCT/EP2017/059270, to which this application claims priority, dated Nov. 21, 2017.
Office Action dated Dec. 24, 2020 issued in Korean counterpart application No. 10-2018-7033232 and English-language translation thereof.
Office Action dated Dec. 8, 2020 issued in Japanese counterpart application No. 2018-554741 and English-language translation thereof.
Office Action issued in Chinese Counterpart Patent Application No. CN 2017800246855, dated Sep. 4, 2020 and English language translation thereof.
Hong, Computer Aided Engineering of Material Forming, pp. 86-87, Metallurgica Industry Press, May 2015, 1st Edition and an English translation thereof.
Office Action issued in Chinese Counterpart Application No. CN 2017800246855, dated Mar. 2, 2021 and English language translation thereof.

* cited by examiner

APPLICATION-BASED CONTROL OF A VALVE DISK

CROSS REFERENCE TO RELATED APPLICATIONS

This application is a continuation application of International Application No. PCT/EP2017/059270 filed on Apr. 19, 2017, and claims priority to German patent application DE 10 2016 107 407.1 filed on Apr. 21, 2016, both of which are hereby incorporated by reference in their entireties.

TECHNICAL FIELD

The present disclosure concerns the field of electropneumatics and relates in particular to an electronic valve controller for the open-loop control and closed-loop control of a pneumatic movement task which is to be executed with a valve assembly, to a valve assembly which is controlled in an open-loop manner and controlled in a closed-loop manner with a valve controller, and to a method for the open-loop control and closed-loop control of a valve assembly and to a pneumatic movement control system.

BACKGROUND

In the related art, it is known to activate fluidically operable actuators via an electronic control device, e.g., in the form of a memory-programmable controller, in that an activation signal is provided by control electronics to a valve device. The memory-programmable controller can be used to provide pre-configured desired valves which can be selected for controlling the valve functions.

It is known from WO 2013/107 466 to specifically con-FIG. a fluid control unit with individual fluid control valves. To this end, it is necessary to record pneumatic parameters relating to the fluid control valves and a piston-cylinder assembly, on which a movement task is to be executed. After a user has determined a valve function, a configuration file can be produced, which contains open-loop control and closed-loop control parameters for the activation of the valve disk.

In this context, it has proven to be disadvantageous that the amount of executable pneumatic movement tasks is already pre-configured. Therefore, the previous system does not prove to be flexible enough to be able to implement different technical applications.

SUMMARY

Therefore, it is an object of the present disclosure to improve a pneumatic system in terms of flexibility and closed-loop control options. Furthermore, the costs and the required installation outlay are to be reduced.

This object is achieved in each case by an electronic execution unit, an electropneumatic system, an electronic valve controller, a method for at least one of an open-loop control or a closed-loop control of a pneumatic valve assembly for executing a pneumatic movement task, and a pneumatic movement control system, as disclosed herein.

The achievement of the object will be described hereinafter with reference to the electronic valve controller. Features, advantages or alternative exemplary embodiments mentioned therein are likewise also to be transferred to the other claimed subjects and vice versa. In other words, the method claim can also be developed with the features which are described or claimed in conjunction with the claims forming the device. In so doing, the corresponding functional features of the method are embodied by corresponding hardware modules, in particular microprocessor modules, of the device (or of the system or of the product) and vice versa.

In another aspect, the disclosure relates to the reading-in of an application on an electronic execution unit which, in an exemplary embodiment, can be configured as a microcontroller of a valve disk.

According to a first exemplary embodiment, the valve disk is arranged directly on a pneumatic piston-cylinder assembly. It can be mounted at that location, integrated into the latter or can be detachably or non-detachably fastened thereto. The valve disk is connected to the piston-cylinder assembly in order to move the piston-cylinder assembly with at least two working channels (and possible ventilation channels). The valve disk forms, together with the piston-cylinder assembly, an electropneumatic device, in particular a cylinder-valve assembly or combination which can be activated by an application.

According to a second exemplary embodiment, the piston-cylinder assembly is offset from the valve disk. In other words, the valve disk is not arranged directly on the piston-cylinder assembly but instead is functionally related thereto via corresponding pneumatic working connections and further data lines.

Typically, provision is made that the application is loaded directly onto an electronic execution unit of the valve disk. This can be a microcontroller.

Furthermore, it is also possible that the application is not loaded directly onto an execution unit of the valve disk, but instead is initially loaded onto an electronic valve controller of a valve island. The application can then be relayed from the electronic valve controller in a dedicated manner to a specific valve disk or to the microcontroller of the valve disk for execution at that location.

It is also possible that the application serves to indirectly control remote further valve assemblies in an open-loop manner. In this context, the term "remote" means remote from the electronic execution unit and/or the microcontroller, on which the application is loaded and implemented. The indirect control can be effected by virtue of the fact that control data are transmitted from a microcontroller of the valve island to at least one microcontroller, which is offset or separate from the valve island, of further valve assemblies of a remote drive element, such as e.g., a robot arm. This has the technical advantage that only one electronic connection line must be provided between the valve island and the further valve assemblies (of the robot arm).

In other words, the electronic execution unit can be used for implementing the application and can be arranged on a valve island:

- in order, on the one hand, to directly control valves or valve assemblies in an open-loop manner and/or closed-loop manner which are arranged on the valve island, and/or in order, on the other hand, to indirectly control at least one further valve assembly in an open-loop manner and/or closed-loop manner which is arranged on an offset drive element in order to execute the respective pneumatic movement tasks at that location (i.e., remotely).

Of course, both controls can be combined, i.e., both a direct open-loop valve control in situ of valves formed on the component, on which the application is also implemented, and indirect open-loop valve control of remote valves not formed on the same component, on which the application is implemented.

According to a further exemplary embodiment of the disclosure, during indirect open-loop control and/or closed-loop control of the further valve assembly by means of the application on the offset drive element only one electrical connection for data, in particular control data and optionally for sensor data, is provided between the valve island and the further valve assembly (or its electronic execution units/microcontrollers). All of the valves of the further valve assembly can be supplied via a common pneumatic supply line which can be guided separately from the electronic connection. In particular, a supply pressure of e.g., 6 bar can be preset in this case.

According to a further exemplary embodiment of the disclosure, the pneumatic supply line of the valves of the further valve assembly (arranged on the offset drive element) is separate from the electrical connection. The amount of tubing can be therefore be reduced.

In one exemplary embodiment, the electrical connection or connection line serves to transmit sensor data which have been recorded at the further valve assembly and transmitted to the application for closed-loop control. In this case, the electrical connection line is bidirectional.

According to a further exemplary embodiment of the disclosure, the electronic execution unit, on which the application is implemented, can be arranged on a component other than on the particular one, on which the pneumatic movement task is to be performed. The latter can be e.g., a structurally separate robot arm.

According to an exemplary embodiment of the disclosure, the pneumatic valve assembly which can be, e.g., a valve disk is controlled in a closed-loop manner on the basis of internal sensor signals which are recorded by sensors arranged locally on the pneumatic valve assembly (e.g., exclusively on the valve disk). This has the technical advantage that the valve disk can be autarkically operated and controlled in a closed-loop manner. Power losses relating to remote piston-cylinder assemblies can be avoided.

According to a further exemplary embodiment of the disclosure, the pneumatic valve assembly is controlled in a closed-loop manner on the basis of sensor signals which are recorded by sensors arranged locally on the valve island. "Locally" means in this case locally in relation to the electronic execution unit, on which the application is loaded. This has the technical advantage that no signal lines have to be routed to the piston-cylinder assembly and maintained.

In both of the aforementioned exemplary embodiments, no sensor signals have to be read-in by the piston-cylinder assembly for the purpose of open-loop or closed-loop control.

Alternatively or cumulatively, the sensor signals can, however, also originate from remote sensors which are arranged remotely on the further valve assembly.

Basically, the further valve assembly can be formed by one valve or can comprise a plurality of valves. It can also be formed by a valve disk or can comprise a plurality of valve disks.

According to another aspect, the object of the disclosure is achieved by an electropneumatic system, comprising at least two execution units, wherein one execution unit is configured as an electronic valve controller of a valve island and a further execution unit is configured as a microcontroller of a valve disk and wherein an application is received on the electronic valve controller and is transferred to the microcontroller where it is used for controlling the valve disk in an open-loop manner and closed-loop manner in order to execute a pneumatic movement task on a piston-cylinder assembly.

In an exemplary embodiment of the disclosure, the communication connection between the valve disk and the valve island is configured as a point-to-point communication channel, in particular with protocol drivers, or is configured as a bus system.

According to a further aspect, the aforementioned object is achieved by an electronic valve controller for the open-loop control and closed-loop control of a valve assembly having at least one pneumatic valve for a pneumatic movement task. In accordance with the disclosure, one application from a set of provided, different applications for the open-loop control and closed-loop control of the valve assembly is loaded or loadable in an executable manner on the electronic valve controller in order to execute the pneumatic movement task.

The application is generated as an executable program code and can be read-in and used or executed directly on the valve island. The application includes control commands for the valve assembly. It is not necessary to connect yet a further electronic entity therebetween. On a calculation unit, different applications are generated in a code generation phase—depending upon the desired movement task or valve function—and are provided as a set of applications for selection by a user. Then, in an execution phase the user can select at least one specific application from the set of applications for the open-loop control and closed-loop control of the respective specific movement task. Reference may be made expressly to the fact that the user can also select a plurality of applications from the set of available applications for open-loop control/closed-loop control. In order to generate the application, the calculation unit can access a model and a library of application objects. The application can be executed on one or a plurality of execution units (as a distributed system). In a typical exemplary embodiment, the execution unit is the electronic valve controller. However, alternatively or cumulatively the execution unit used can also be a further electronic entity having the corresponding technical requirements (processor performance, storage space, input ports, output ports or interfaces etc.), e.g., a microcontroller of a valve disk or a control apparatus in the form of a memory-programmable controller. In other words, the respective execution unit can again be configured as a distributed system.

According to an exemplary embodiment, the valve assembly is a so-called valve island which comprises a plurality, in particular 4 or 8, valve disks, wherein the valve disks can have an identical structure and are controlled in an open-loop manner and controlled in a closed-loop manner centrally via the electronic valve controller. The electronic valve controller is likewise arranged locally on the valve island. Alternatively, it can be configured as a distributed system, wherein the individual controller modules exchange data. The controller modules can be configured as microcontrollers, e.g., on the valve disks.

The individual valve disks of a valve island are valve modules having four valves. The valves are control elements for controlling the working elements or apparatuses (such as a piston-cylinder assembly) in an open-loop manner. The valve disks can each execute different types of movement, movement tasks or pneumatic functions and therefore can be activated differently. It is also possible that one and the same valve disk sequentially executes different partial movement tasks in different types of exemplary embodiment (throttled, noise-reduced, etc.) and is activated accordingly. The valve disks of a valve island can execute different types of movement and movement tasks in parallel in the same time interval. Therefore, the movement task also includes an execution mode which can be controlled in a closed-loop manner, a movement type (throttled, energy-efficient, etc.) which can be adjusted by the user.

For its part, a valve disk comprises an electronic valve disk controller which serves to activate the four valves of the valve disk. These four valves are connected in the manner of an electrical Wheatstone bridge in order to be able to provide or execute superior valve functions.

According to an exemplary embodiment of the disclosure, the electronic valve controller has a plurality of interfaces, comprising pneumatic connections and electric connections, and data connections which can be configured as (possibly different) bus systems which can be operated with different protocols. The electronic valve controller comprises in particular an interface to a calculation unit which is configured typically as a bidirectional interface for data exchange. The calculation unit serves to produce an application on the basis of the movement task input via an editor or via another input means (electronic, acoustic, optical, etc.). The application is generated in the code generation phase. In a simple variant of the disclosure, all of the selectable applications are generated in this code generation phase and—depending upon the application—can be selected by the user and loaded onto one or a plurality of execution units for execution purposes. A modified version of an already selected and loaded application can be generated in the execution phase, in that the application is adaptively parameterized according to DESIRED specifications. It is not necessary to load the application once again onto one of the execution units.

It is expedient if the electronic valve controller has an internal measurement signal unit integrated thereon, via which the electronic valve controller receives internal or local measurement signals of the valve assembly, in particular the valve island with all of the valve disks, and calculates them for closed-loop control. The calculation is effected typically directly on the electronic valve controller. Alternatively, the closed-loop control variables are relayed via a closed-loop interface to the calculation unit for processing therein. This has the advantage that the execution of the movement task can be controlled in a closed-loop manner quasi in real time with the aid of the recorded and predefinable pneumatic conditions. Typically, the user can determine in advance which physical conditions he would like to know are considered for closed-loop control (e.g., temperature, energy, flow etc.). These closed-loop control variables are recorded according to likewise pre-definable events (time-based events, e.g., periodically or status-based events, e.g., after execution of a specific movement sequence of the movement task) and are relayed to the calculation unit or execution unit(s) for closed-loop control. Therefore, it proves to be advantageous that not only the measurement signals of a valve disk are taken into consideration but also the measurement signals of the valve disks—located in parallel in use—of the same valve island or the group of components including valve disks and internal sensor signals of a piston cylinder assembly.

In an exemplary embodiment of the disclosure, the closed-loop control of the valves of the valve island for executing the movement task is effected on the basis of internal measurement signals of the valve island, i.e., measurement signals or sensor signals which are recorded on the valve island, and on the basis of external process signals and/or external closed-loop control variables and/or external measurement signals. As already mentioned, in the internal measurement signals, measurement signals of different valve disks can certainly be recorded and are relayed, with an allocation to the respective valve disk, to the calculation unit or execution unit(s) for the purpose of closed-loop control. Therefore, valve disk-specific closed-loop control can be executed in an advantageous manner. The external parameters (external process signals, closed-loop control variables, measurement signals) can be pneumatically relevant physical parameters which are recorded or provided outside the valve island, e.g., specifications for energy consumption, freedom from vibrations or noise generation. The external variables are typically process signals of the technical process, in the context of which the movement task is to be executed (e.g., fill level signals or position signals of the production process for moving components by means of the pneumatic valve assembly or e.g., signals of a robot etc. to be moved). A closed-loop control circuit or a corresponding closed-loop control algorithm is provided in order to compare the recorded ACTUAL specifications (these are typically also continuous signals or signal or curve progressions) of the respective closed-loop control parameters with pre-definable DESIRED specifications in respect of agreement and to control them in a closed-loop manner accordingly. Since these closed-loop control variables differ from application case to application case, provision is made in one exemplified exemplary embodiment that the external and internal closed-loop control variables can be defined in advance and in particular in a code generation phase, so that unnecessary measurement values do not have to be recorded and processed and instead only those measurement values which are relevant to the respective application have to be recorded and processed.

In simpler exemplary embodiments, the closed-loop control can be executed only on the basis of the internal or external closed-loop control variables.

Fundamentally, the closed-loop control ensures that a modified application is produced in that the application is parameterized with calculated DESIRED specifications and is executed in this parameterized version on the execution units. In one development, provision is made to design the data-technical system for generating the application, in particular a so-called calculation unit or the execution unit as a self-learning system. In this case, during the execution of the movement task feedback and diagnosis information is recorded (typically on execution units on which the application is executed, i.e., for example, on the valve island or on units which exchange data with the execution units) which is relayed to the calculation unit for generating or parameterizing the application. In other words, during execution of the intended movement task the valve assembly can also be controlled in an open-loop manner by different versions of the application, wherein different versions or parameterizations of an application are based upon closed-loop control variables being taken into consideration.

In a first exemplary embodiment, the generated application is loaded directly onto the electronic valve controller for execution purposes. In this case, it is no longer compulsory to use a further control unit, e.g., a memory-programmable controller. However, it can certainly be possible to optionally incorporate, in addition, an external control unit into the system, e.g., in the form of a memory-programmable controller. In this case, the application which is loaded onto the electronic valve controller is incorporated into a control program for the respective valve island which is provided on the memory-programmable controller. Therefore, the execution of the application on the electronic valve controller can be triggered via the memory-programmable controller in particular by start control commands and end control commands and optionally by an emergency shut-off facility in the event of an emergency. Therefore, in accordance with the disclosure the open-loop control task and the closed-loop control task for the valve island are no longer implemented and executed indirectly by the memory-programmable controller (not even when this is used), but instead directly by the electronic valve controller on the valve island and thus locally on the valve island. Therefore, in a manner of speaking intelligent functionality for open-loop control and closed-loop control directly in situ can advantageously be relocated to the valve island. In another exemplary embodiment, the digital programmable control apparatus can have yet further control applications provided thereon which can be loaded onto the electronic valve controller for the purpose of executing the pneumatic movement task. However, the memory-programmable controller is typically used only to execute superordinate functions and to coordinate with other units of the technical application system (robot control etc.). The memory-programmable controller then coordinates the movement sequences in connection with e.g., electrical drives in order to avoid e.g., a collision during an EMERGENCY shut-off.

In a second exemplary embodiment, the generated application is not loaded directly onto the electronic valve controller for execution purposes, but instead is loaded onto the digital programmable control apparatus. This then transmits the control commands to an execution unit, in particular to the electronic valve controller. The control commands can be incorporated into an executable program code which also prompts, e.g., the recording of specific measurement values as closed-loop control variables.

According to a further aspect, the aforementioned object is achieved by an electronic execution unit, on which the generated application is loaded and executed. These units are electronic or digital processor units which are formed on a valve assembly and in particular on a valve island, in particular the electronic valve controller, a control unit (microcontroller) on an individual valve disk or an entity which exchanges data with the memory-programmable controller or the calculation unit. The electronic control unit serves to control the pneumatic valve assembly in an open-loop manner and/or closed-loop manner in order to execute the pneumatic movement task (of a movement unit, such as a robot arm).

According to a further aspect, the aforementioned object is achieved by a method for the open-loop control and closed-loop control of a pneumatic valve assembly for executing a pneumatic movement task, comprising the method steps of:

- reading-in the pneumatic movement task;
- automatically generating an executable program code on the basis of the recorded pneumatic movement task with access to a library of application objects and distributing the individual application objects to at least one or a plurality of execution unit(s) of the valve assembly; and
- loading the executable program codes as an application in real time on at least one or a plurality of execution unit(s) of the valve assembly. Typically, the procedure of loading is also followed by the application being executed.

Typically, internal measurement signals of the valve island and the valve disk (valve assembly) recorded during execution of the application (and therefore during execution of the movement task by means of the valve assembly) and external process signals of the technical system are relayed as pneumatic closed-loop control variables to an execution unit in order to generate a modified application, namely a parameterized application (or another version of the application) and to load this onto the execution units (e.g., the electronic valve controller) for the purpose of execution. This procedure can be executed in real time and in particular in a range of 0.5 milliseconds to 5 milliseconds so that the parameterized application is available in real time on the execution units. Even when a modified application is produced (i.e., a closed-loop controlled application), this can be loaded in real time onto the execution units. This also applies to an application modified by feedback.

In practice, it has proven to be expedient that, for the open-loop control or closed-loop control of the valve assembly, the following operating conditions, i.e., execution modes or movement variants, are taken into consideration and can also be selected and applied in combination. They can be displayed e.g., also in the form of a plug-in on a user interface, e.g., the calculation unit or another apparatus, for selection:

- damping a piston movement by providing a damping function, in particular a soft stop,
- controlling the speed of a piston in a closed-loop manner by providing a throttle function for controlling the piston speed,
- providing a pressure control and/or pressure progression control,
- time of execution of the movement task,
- energy efficiency of the movement task,
- specification of the valve function
- movement with intermediate stops and/or separate movement sections
- movement task for the purpose of diagnosis and
- further criteria which can be relevant for the respective application, such as freedom from vibrations, heat development, current consumption and/or sound emission when executing the movement task etc.

The method can be used for controlling the valve assembly in an open-loop manner and in a closed-loop manner. It is also possible to specify the valve function. To this end, a specific application can be selected from a provided set of applications and is then loaded onto the execution units.

To control the valve assembly in a closed-loop manner, internal (valve island-internal) measurement signals of the valve assembly and external (valve island-external) closed-loop control variables are typically taken into consideration. At least two separate closed-loop circuits are provided: a first closed-loop circuit is located on the respective valve disk and controls the four respective valves of the valve disk in a closed-loop manner on the basis of sensors (e.g., pressure sensor or position sensor) arranged on the valve disk or on the respective valves. A second closed-loop circuit is provided on the electronic valve controller. This closed-loop circuit controls the behavior of all of the valve disks of the valve island, also in relation to one another, in a closed-loop manner.

It can process internal measurement signals of an internal measurement signal unit. In a further exemplary embodiment of the disclosure, a third closed-loop circuit can be provided. The third closed-loop circuit can be located outside the valve island on an electronic component or on the memory-programmable controller and can process external sensor signals, e.g., pressure signals or other sensor signals (temperature etc.) which then move an actuator (gripper) to a specific position in order to prevent a collision in the event of an EMERGENCY shut-off. In this connection, process signals of an external sensor unit are processed. The memory-programmable controller can be used also to control the correct sequence of the respective movement tasks of the individual valve disks of the valve island by means of corresponding commands (e.g., "move cylinder 1 from A to B and after an interval of 5 seconds move cylinder 1 in a throttled manner from B to C and cylinder 2 from A to D"). In a further exemplary embodiment of the disclosure, a fourth closed-loop circuit can be implemented which adapts or parameterizes the application with the aid of specifications of the user with respect to the execution mode of the movement task (damped, noise-reduced, etc.). The specifications are input via a user interface and are then calculated automatically by means of an algorithm into DESIRED specifications which are used for parameterizing the application. The application comprises 2 segments: a main part and a desired specification-dependent part which is parameterized differently by corresponding desired specifications. The main part of the application remains unchanged even during parameterization. This has the advantage that even when the execution mode of the movement task is changed or in the case of changed closed-loop control variables, it is not necessary to re-compile and repeatedly load the application. Therefore, the process costs and management outlay can be considerably reduced. This superordinate closed-loop circuit can be produced by regenerating and subsequently downloading an application onto the execution unit(s).

According to a further aspect, the aforementioned object is achieved by a pneumatic movement control system for the open-loop control and closed-loop control of a pneumatic valve assembly for executing a pneumatic movement task, comprising:

- an editor as a user interface for recording the pneumatic movement task;
- a calculation unit which is configured, on the basis of the recorded pneumatic movement task, to generate an executable program code or select an already generated program code which is provided as an application and to parameterize this code with the aid of closed-loop control data and/or process signals; and
- at least one execution unit which is arranged on the valve assembly and in each case is configured to read-in the application and execute it in order to control the valve assembly in an open-loop manner according to the recorded movement task and/or to control the valve assembly in a closed-loop manner on the basis of internal variables and closed-loop control variables.

The pneumatic movement control system comprises at least one internal measurement signal unit which is used for recording internal or local measurement signals of the valve assembly which are used in real time to generate the executable program code for controlling the pneumatic movement task in a closed-loop manner. Typically, each valve island comprises one such measurement signal unit.

The calculation unit of the pneumatic movement control system typically comprises:

- an interpreter which is configured to separate the recorded movement task into a series of tasks;
- a compositor which is configured to access a memory comprising stored application objects in order to select, for each task from the total set of tasks, the application objects necessary for this task in order to generate an executable program code therefrom;
- a distributor which is configured to distribute the generated executable program code to at least one execution unit and load it at this location; and
- an executor which is typically configured as an execution unit to execute the generated executable program code in real time, and which is optionally configured to record internal measurement signals as closed-loop control variables and to return them in order to generate a modified (parameterized) executable program code.

And optionally:

- a matcher which is configured to access a license memory and/or an external memory (database) storing a library of application objects requiring a license. The matcher serves to continuously optimize application generation. Typically, the compositor for generating an application accesses the internal memory comprising application objects, in which already licensed or license-free application objects are located. However, for optimization purposes the system can access an external memory entity which can be configured as a cloud solution in which application objects requiring a license are located. They must first be licensed by a further measure on the part of the user (after display on the user interface and agreeing to the license conditions) in order to be available for generating an application. The application objects in the external memory also comprise such application objects which are optimized for different conditions and criteria.

A further improvement can be achieved if the pneumatic movement control system comprises an optimization module which is configured to optimize and/or control the pneumatic movement task in a closed-loop manner, in that during generation of the executable program code, predefinable optimization criteria are taken into consideration. Pre-definable optimization criteria can be time-related criteria (duration, rapidity), energy efficiency, sound or heat development etc.

The object is further achieved by a computer program, comprising computer program code, for carrying out all of the method steps of the method described in more detail above when the computer program is executed on a computer. In this connection, it is also possible for the computer program to be stored on a computer-readable medium and to be sold as a computer program product.

In the following detailed description of the drawings, exemplary embodiments, which are not to be understood to be limiting, together with the features and further advantages thereof will be discussed with the aid of the FIGS..

DESCRIPTION OF EXEMPLARY EXEMPLARY EMBODIMENTS

The disclosure will be explained hereinafter in more detail with reference to the FIGS.

Figure 1:
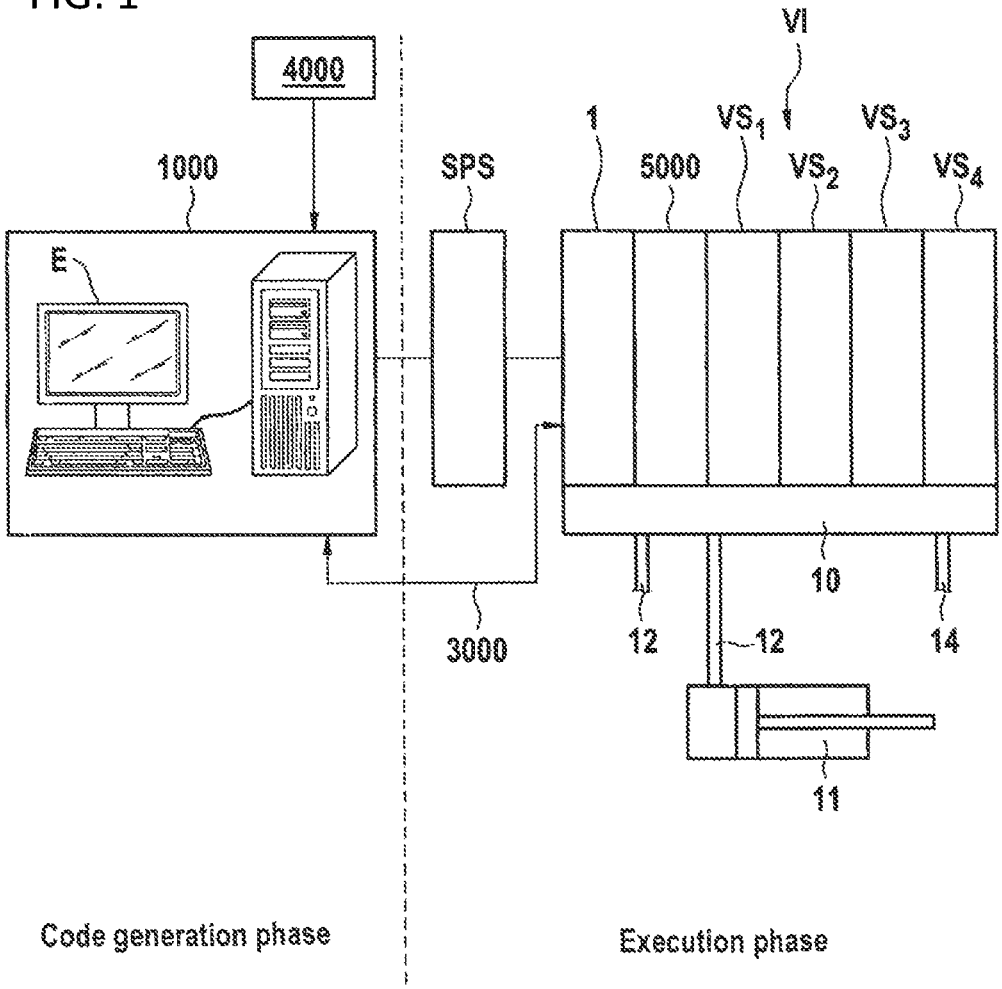
FIG. 1 shows a schematic view of a pneumatic system according to one advantageous exemplary embodiment of the disclosure.

FIG. 1 shows a schematic overview of components of an electropneumatic system according to one advantageous exemplary embodiment of the disclosure. A calculation unit 1000 comprises a processor for calculating and comprises, or is connected to, a monitor which can be configured as an editor E for inputting movement tasks. The calculation unit 1000 can be a computer unit which is illustrated by way of example on the left-hand side of FIG. 1, such as a personal computer or a network of a plurality of computer entities connected via a network. The network can be a wired network (e.g., wired LAN) or a wireless network (e.g., WLAN). Within the scope of the application, it is likewise apparent to a person skilled in the art to provide other designs of the calculation unit 1000, such as e.g., mobile data processing apparatuses, such as a tablet, a handheld, a smartphone, a laptop or the like which can also be used in combination as a distributed system. The respective apparatuses of the calculation unit 1000 can be connected via a network (LAN, WAN, WLAN, etc.) to further digital and/or electronic entities of the system (SPS; electronic valve controller 1 etc.). Optionally, in one exemplified exemplary embodiment the calculation unit 1000 can exchange data with a memory-programmable control apparatus SPS; however, this is not absolutely necessary.

Fundamentally, the disclosure aims to adaptively activate pneumatic valves of a valve assembly in order to be able to cover different application scenarios and in order to be able to take closed-loop control variables, which are recorded during execution of the valve movement, into consideration during the further activation. To this end, depending upon the respective movement task of the application including further technical criteria (e.g., requirements relating to time of execution, energy consumption etc.) in a first code generation phase a program code is generated which can be executed as an application A on electronic execution units of the electropneumatic system, such as e.g., on an electronic valve island controller 1, a memory-programmable control apparatus SPS and/or on a microcontroller 124. To this end, the application A contains or generates inter alia valve control commands. In a second time phase, the valve movement phase or execution phase, the generated application A or the generated valve control commands are executed on the execution units of the valve assembly, e.g., on the electronic valve island controller 1 of a valve island VI (valve terminal) or on the electronic valve controllers (microcontroller 124) of a respective valve disk VS or a valve V or on a further valve assembly WV.

All of the electronic execution units which—depending upon the exemplary embodiment of the disclosure—can be arranged on the valve island VI (as the valve island controller 1) and/or on a valve disk VS and/or on an individual valve V and/or on further valve assemblies WV can be configured having a network interface. The network interface can comprise an input interface and/or an output interface. During data transmission via the network, a protocol of the IP family can be used as a transport layer, such as e.g., based on the IEEE 802.3 standard, in particular the Ethernet. For instance, UDP packets can be transmitted to the respective electronic execution unit (e.g., the application A or control data) for execution purposes. Likewise, UDP packets can be transmitted to the electronic execution unit, such as e.g., sensor data packets.

The network interface can be wired.

It is also possible to provide an adapter on the electronic execution unit in order to couple the wired data transmission to a wireless transmission of data and to achieve wireless data transmission from/to receiver nodes. The adapter can be formed e.g., by a field bus coupler.

Therefore, the application can be operated by a mobile device (e.g., tablet, smartphone) in order to control the valves in an open-loop manner according to the pneumatic movement task by means of wireless data transmission.

Furthermore, it becomes possible to transmit locally recorded sensor data wirelessly to a receiver node in order to be processed therein (e.g., for the purpose of closed-loop control) or to be relayed from this location to a further node.

In an example of an exemplary embodiment of the disclosure, the valve island controller 1 can be configured having an Ethernet interface, via which data can be transmitted and/or received per UDP. The data can be digital data (e.g., control data for valve activation) and/or analogue data (e.g., sensor data, such as pressure measurement data).

The two time phases can be interleaved in terms of time (interleaved mode). This proves to be advantageous in particular when, during execution of the movement, closed-loop control values are recorded which are to be used for closed-loop control of the movement task. Then, a parameterized version of the application A can be generated and executed on the execution units 1, 124, SPS without reloading and compiling the application A. The parameterized version is based upon DESIRED specifications which are calculated from the recorded external and internal closed-loop control variables. The DESIRED specifications can be discrete or time-continuous signals (e.g., a curve progression). Therefore, as the movement task is being executed it is advantageously possible to change even an execution mode (e.g., damped, energy efficient etc.).

During the code generation phase, the calculation unit 1000 is active and intended to generate a set of applications. The calculation unit 1000 is connected via an interface to an external sensor unit 4000, via which external closed-loop control variables or process signals of the technical process (robotics, production, etc.) can be read-in. In other exemplary embodiments, the external sensor unit 4000 can also cumulatively or alternatively exchange data with the memory-programmable control apparatus SPS and/or with the electronic valve controller 1 and transmit its sensor signals to these entities for closed-loop control (this is not illustrated in FIG. 1). During the valve movement or execution phase, the respective execution unit 1, 124 is active on the valve assembly. This is to be represented in FIG. 1 by the vertical broken line. The open-loop control of the valve function and thus the movement task is effected by selecting a specific application A from the set of provided applications.

A valve island VI comprises four or eight cuboidal valve disks VS and the electronic valve island controller 1 which, centrally or as a distributed solution, is responsible for the open-loop control in each case of an valve island VI having the valve disks VS arranged thereon, and an internal measurement signal unit 5000. The internal measurement signal unit 5000 is intended to record pneumatic measurement values, such as inter alia pressure, stroke (travel), flow, temperature as local or internal measurement signals on the valve island VI and to relay these values to the electronic valve island controller 1 and/or to further electronic instances for processing and closed-loop control. In the code generation phase, the user can determine the parameters for which values are to be recorded and taken into consideration during calculation and for code generation. Integrated on the valve island VI can be a dummy plate for optional, further insertion modules and an interface node which can be configured e.g., as a bus node and/or as an Ethernet, web-visualization interface. All of the components of the valve island VI are fastened to a base plate 10. The base plate 10 can be produced from an extruded aluminum profile and has pneumatic connections for connecting tubes, e.g., working connections 50 (not shown in FIG. 1 but shown in greater detail in FIGS. 4*a* and 4*b*) and connections for inlet air and outlet air, in particular ventilation for sound absorbers. Furthermore, electric connections 14 for cables and electronic interfaces are provided.

FIG. 1 schematically indicates on the right-hand side that the pneumatic connection 12 serves as a working channel and is in communication with a working apparatus, in this case a piston-cylinder assembly 11, in order to move the assembly. As shown in FIG. 4, typically a plurality of working connections 50 are provided, in this case two per valve disk VS. In the piston-cylinder assembly 11, further sensors are configured in the form of a piston-cylinder sensor unit 6000, comprising e.g., individual or combined end position sensors, position sensors, stroke sensors, pressure sensors etc. These internal sensor signals are relayed typically directly to the electronic valve controller 1 for closed-loop control. They can be calculated directly on the electronic valve controller 1 together with the local or internal measurement signals of the internal measurement signal unit 5000 and with external process signals of the external sensor unit 4000 for closed-loop control.

In the typical exemplary embodiment of the disclosure, all of the valve disks VS of a valve island VI have an identical structure which will be described later in connection with FIG. 2.

The electronic valve controller 1 is used for open-loop control and closed-loop control of the valves which are provided in the valve assembly VS, VI. In a typical exemplary embodiment of the disclosure, the valve assembly is formed by the valve island VI and the execution unit for executing the application A is the electronic valve island controller 1 which, centrally and simultaneously, can activate and control in a closed-loop manner a plurality of (four or eight) valve disks VS of the valve island VI.

The basic principle of the disclosure is explained hereinafter with reference to FIG. 5. The calculation unit 1000 comprises the editor E or communicates data therewith (this case is illustrated in FIG. 1). The editor E serves to input a movement task of any type, such as e.g., "move a body X from position A to position B and execute this as quickly as possible", "execute throttled travel", "execute movement X and terminate it with a soft stop" etc. The movement task can comprise a plurality of task sequences or partial movements which are to be executed at definable time intervals. The movement task can also be executed in different execution modes (throttled, energy-efficient, vibration-free etc.).

Fundamentally, the movement task defines the physical procedure of moving a mass within a three-dimensional space or along a path at a determinable speed and at a determinable acceleration and optionally with determinable energy consumption. Typically, the movement task is input into a provided model of a software development platform by a user. However, it is also within the scope of the disclosure to read-in the movement task to be executed from a file, in particular a parameterization file (e.g., for platforms such as Matlab/Simulink, Codesys or the like). Likewise, the movement task can be stored in a memory. The movement task can be provided in different formats (as a text file, image file or video recording, in a machine-readable format etc.). In the underlying model, the respective pneumatic requirements are defined. The software development platform is typically configured such that the model can be simulated and tested and can automatically generate code (e.g., C++ code). The generated code is executable program code. In a typical exemplary embodiment of the disclosure, the model is generated in a Matlab-Simulink environment. Simulink® is a block diagram environment for the model-based technical development and assists the design and simulation at system level and also permits automatic code generation and continuous testing and verification of embedded systems. However, other models and platforms can also be applied.

As already mentioned, the method in accordance with the disclosure is divided basically into two time phases:

1. A code generation phase, in which an executable code in the form of an application A is generated automatically from the recorded movement task. By taking closed-loop control variables into consideration, the application A can be continuously modified and refined. For instance, the model for code generation can be configured as a self-learning system.
2. A valve movement phase or execution phase: in this phase, the movement task is actually performed, in that the valves of the valve assembly VS, VI are activated according to the specifications of the provided application A. To this end, the application A is executed on one or a plurality of execution units 1, 124 of the valve assembly VS, VI. Typically, pneumatic measurement values and measurement values relevant to the respective application case are recorded on each valve island VI in one or a plurality of internal sensor units, the measurement values being returned as closed-loop control variables for application generation or application modification in order to improve, refine or modify the application and to load it in a modified (in particular parameterized) version onto the execution units. Cumulatively, external closed-loop control variables can also be used for application parameterization.

The calculation unit 1000 is provided in order to automatically generate the executable program code on the basis of the recorded pneumatic movement task. As can be seen in FIG. 5, the calculation unit 1000 comprises a plurality of modules which all exchange data via a network, namely an interpreter 1002 which is intended to separate the recorded movement task into a series of tasks. The tasks can be movement sequences to be executed one after the other. Furthermore, the calculation unit 1000 comprises a compositor 1006 which is configured to access a memory 1004 comprising stored application objects in order to select application objects necessary for each task from the set of tasks in order to generate an executable program code therefrom. Furthermore, the calculation unit 1000 is provided with a distributor 1020 which is configured to distribute the generated executable program code to at least one execution unit, namely to the electronic valve controller 1 and/or the microcontrollers 124 of a valve disk VS and/or to the memory-programmable control apparatus SPS and to load it at this location. Furthermore, the calculation unit 1000 comprises an executor 1022 which is configured to execute the generated executable program code. In the main exemplary embodiment of the disclosure, the executor 1022 is configured as an execution unit 1, 124 on the valve island VI. Alternatively or cumulatively, the executor 1022 can be provided as a superordinate entity, such as e.g., as a memory-programmable control apparatus SPS which assumes yet further, coordinating tasks, for instance in connection with working apparatuses of the technical process installation. The execution units 1, 124, SPS are configured not only for executing application programs but also for recording internal measurement signals of the valve assembly, in particular of the valve island VI, as closed-loop control variables and to return them to the calculation unit 1000 for generating a modified, executable program code. The closed-loop control interface 3000 is available for this purpose.

The generated application A can be loaded directly onto the electronic valve controller 1 and/or onto the other distributed execution units for execution purposes. In this case, the use of a memory-programmable controller SPS for activating the valve assembly VS, VI is no longer absolutely necessary. It is also possible for the application A or parts thereof to be loaded onto the control apparatus SPS which then relays the code to the electronic valve controller 1 for open-loop control purposes. Typically, after loading the application A onto the electronic valve controller 1, the program code can be integrated on the memory-programmable controller SPS so that it can trigger the program sequence. Therefore, the memory-programmable controller SPS can be used to transmit at least one start command and one end command for the movement task to the electronic valve controller 1.

Furthermore, in a typical exemplary embodiment of the disclosure the calculation unit 1000 comprises a matcher 1008 which is configured to access a license memory 1010 and/or an external memory 2000, in which a library of application objects requiring a license is stored in each case. The external memory 2000 can be configured as a cloud-based library of application objects. The license memory 1010 stores license data relating to the application objects. The matcher 1008 is configured to optimize the generation of the executable program code in terms of different aspects. This is achieved by analyzing whether application objects requiring a license exist in the license memory 1010 and/or the external memory 2000 which are suitable (and possibly more suitable) for executing the recorded movement task taking into consideration internal and external closed-loop control variables than the previous application objects which have been previously used from the memory 1004. If this is the case and "better" application objects are provided for the movement task under the recorded measurement conditions (by means of the recorded closed-loop control variables), the type of available application objects and their license conditions can be displayed to the user on a user interface. If the user agrees with the license conditions by paying a corresponding license fee, the respective application object requiring a license can be loaded from the external memory 2000 and/or from the memory 1004 (if this also comprises application objects requiring a license) and can be used for generating the application A. In parallel, the license data record is updated in the license memory 1010. The acquired or licensed application object can be relayed to the compositor 1006. It should be noted that the user interface for inputting the movement task and displaying the suitable application objects requiring a license from the memory 1010 do not have to correspond.

In a typical exemplary embodiment of the disclosure, the editor E and the calculation unit 1000 are located on the same system, whereas the electronic valve controller 1 and the valve assembly VS, VI are integrated in one component which, however, is located at a remote location (distributed system) or is connected via corresponding data interfaces. In an alternative exemplary embodiment of the disclosure, additional structural and/or computer-based units can also be provided in this case so that, e.g., the editor E is not located on the system of the calculation unit 1000.

The pneumatic movement control system advantageously comprises an optimization module which is configured for optimization and/or closed-loop control of the pneumatic movement task, by taking into consideration optimization criteria which can be pre-defined during the generation of the executable program code, such as e.g., optimization with regard to the required time, energy, compressed air etc.

Figure 5:
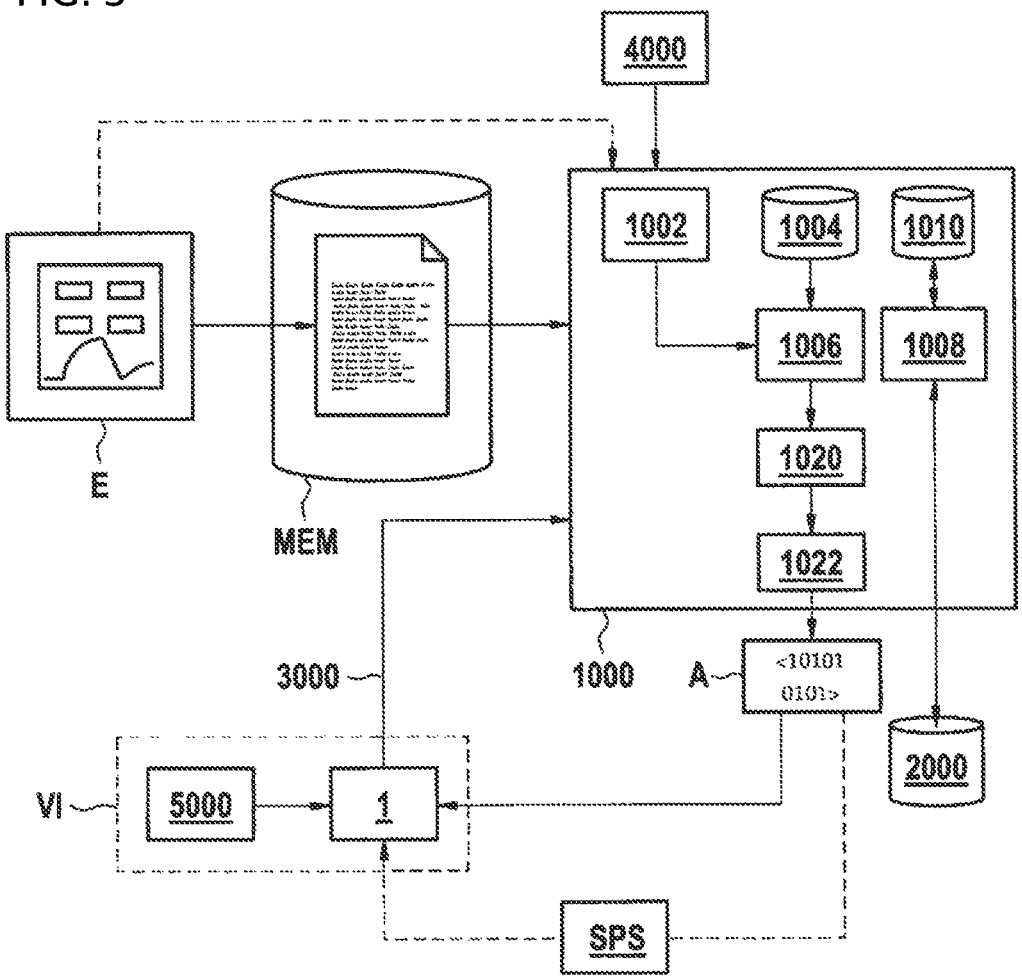
FIG. 5 shows an overview of components of the pneumatic system according to one advantageous exemplary embodiment of the disclosure and the interaction thereof.

As illustrated in FIG. 5, closed-loop control variables are taken into consideration during generation of the executable program code. A typical exemplary embodiment of the disclosure relates both to internal and external closed-loop control variables. In this context, "internal" refers to physical measurement signals which are recorded on the internal measurement signal unit 5000 arranged on the electronic valve controller 1, thus relating to valve island-internal and local measurement signals. "External" is intended to denote that any pneumatically relevant external closed-loop control variables (i.e., valve island-external and e.g., central or global variables) can be read-in and taken into consideration for generating the application A. The external closed-loop control variables are read-in from an external sensor unit 4000. The internal closed-loop control variables are returned via the closed-loop control interface 3000 from the valve island or electronic valve controller 1 to the calculation unit 1000.

Figure 2:
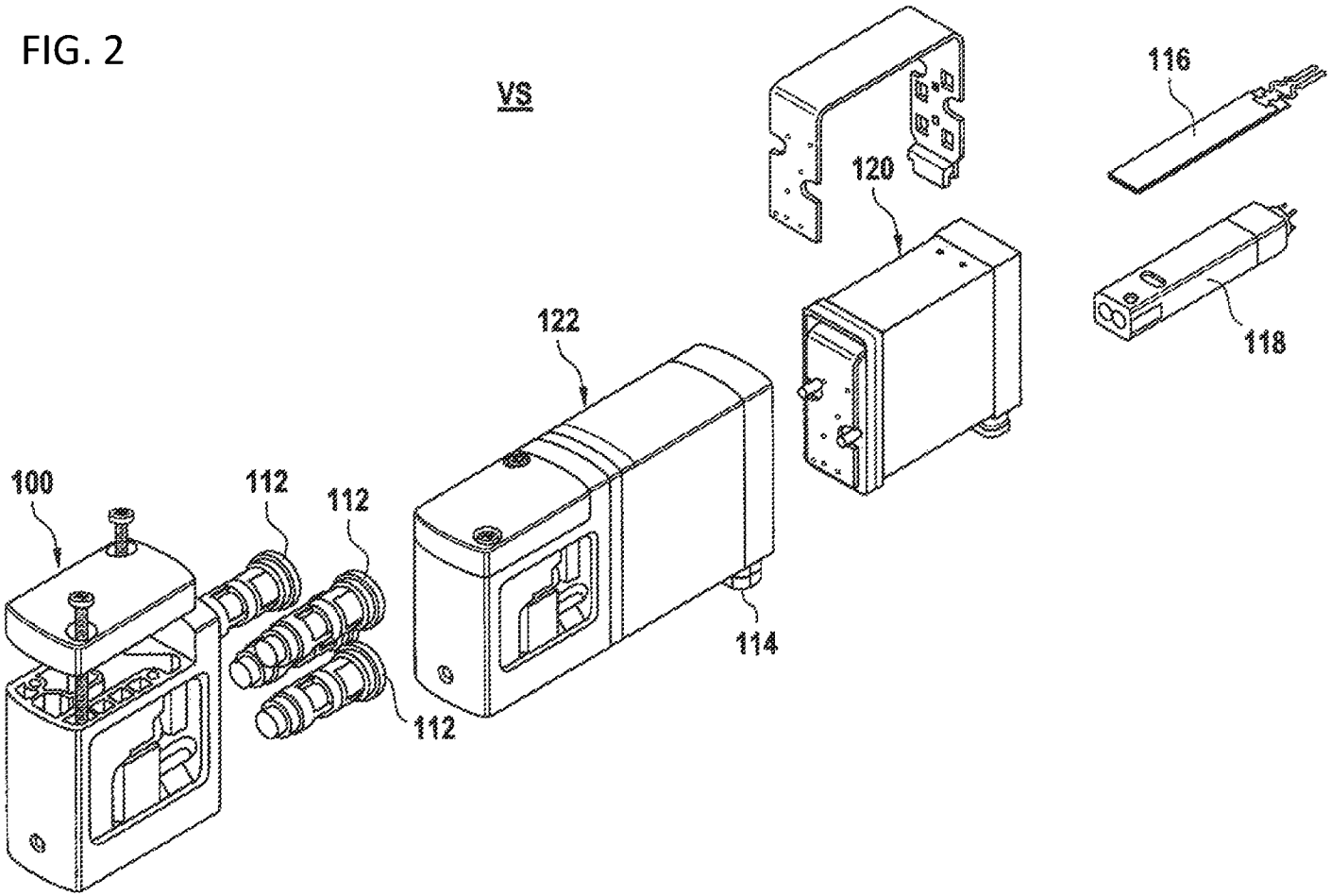
FIG. 2 shows an exploded view of a valve disk in one exemplified exemplary embodiment.

FIG. 2 shows the substantial components of a valve disk VS with a unit of four valves. It comprises a housing 100, in which the—in this example—four booster cartridges 112 are mounted. The booster cartridges 112 serve to increase flow locally or at selective points. Arranged in a central part of the valve disk VS is an electronics circuit board 120, in which a serial synchronous data bus (serial peripheral interface, SPI) 114 is arranged, with which digital data can be exchanged according to a master-slave principle. In addition, sensors can be formed in the electronics circuit board 120. The valve disk VS comprises, in addition to the electronics circuit board 120, a valve unit having valves 118 and a piezo-actuator 116. The piezo-actuator 116 typically comprises a plurality of layers of thin piezoelectric layers which expand or move when a voltage is applied and thus serves as an electropneumatic interface. The components are installed with a fastening element 122 to form a complete module.

Figure 3:
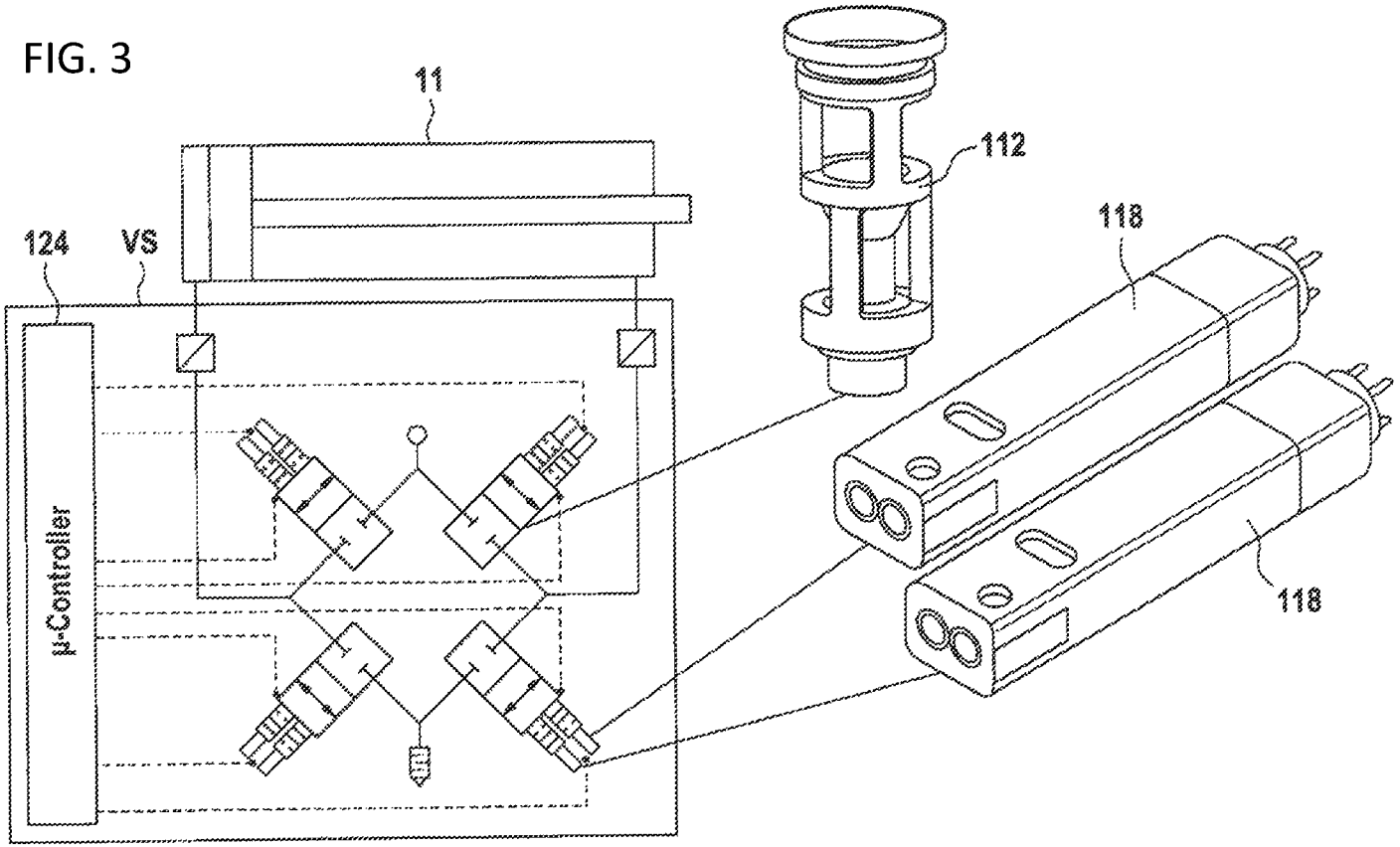
FIG. 3 shows further components of a valve disk.

FIG. 3 shows the structure of a valve disk VS according to a typical exemplary embodiment of the disclosure. It comprises four valves 118 in a valve unit which control two cylinder chambers of a cylinder independently of one another via a bridge circuit (e.g., in the manner of an electrical Wheatstone bridge) in order to be able to provide superior valve functions. A booster 112 serves in each case to increase flow. Each valve disk VS comprises a controller unit which can be configured e.g., as a microcontroller 124 in order to provide an activation voltage, which is defined corresponding to the movement task of the application A to execute a valve stroke or to adjust pressure ratios. In one exemplary embodiment of the disclosure, the microcontroller 124 serves to control the individual valves and communicates data, in particular exchanges data (bidirectionally) with the electronic valve controller 1 (not illustrated in FIG. 3). In another exemplary embodiment of the disclosure, each valve disk VS has microcontrollers which, however, as an execution unit, serve to execute the application A; they communicate data with the respective other microcontrollers of other valve disks VS of the same valve island VI.

In accordance with the disclosure, the valve function of the valve disk VS (e.g., as 4/2–, 4/3, 2×3/2, 2×3/3 directional control valves etc.) and further functions, execution modes and operating conditions of the valve (e.g., soft stop, eco-mode, pressure control, flow control etc.) can be adaptively changed by the application A. The selection of the valve functions and operating conditions is possible even when one and the same valve mechanism or valve construction is to be used. Therefore, in accordance with the disclosure, in the case of a specific pneumatic system (having specific physical components) the valve function can be adapted variably to the application case with the respective movement task.

Figure 4A:
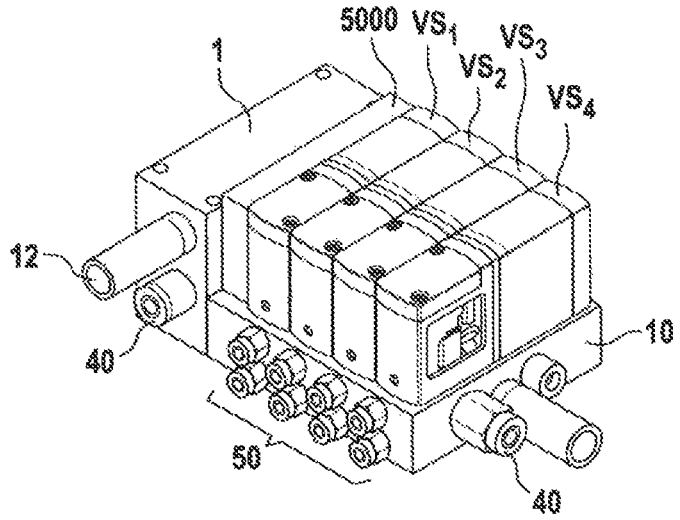
FIG. 4A is a schematic exemplary view of a valve island comprising four valve disks and FIG. 4B shows a valve island comprising eight valve disks.
Figure 4B:
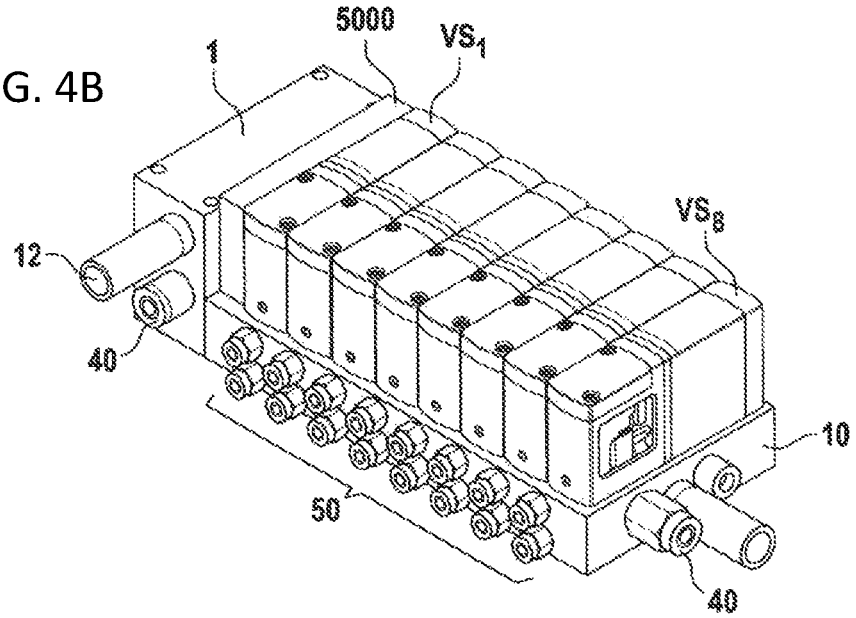

FIG. 4 illustrates a valve island VI in different exemplary embodiment variants: FIG. 4A illustrates a valve island VI including four valve disks VS and FIG. 4B illustrates a valve island VI including eight valve disks VS. The reference sign 40 designates by way of example a supply connection or pressure connection. The valve island VI comprises an internal measurement signal unit 5000 for recording local measurement signals. The measurement signals can be all of the pneumatically relevant, physical measurement variables, such as temperature, pressure, position of the valve spool (stroke), flow, flow rate etc. The signals can be time-continuous or discrete signals. The respective physical variables can be determined by a plurality of sensors and are then provided as an averaged signal. The closed-loop control variables of the internal measurement signal unit 5000 which are to be recorded are defined in the code generation phase. Ventilation is designated by the reference sign 12. A plurality of working channels or working connections 50 control and move a working apparatus, in this case a piston-cylinder assembly 11, not illustrated.

In one exemplified exemplary embodiment, the electronic valve controller 1 can be used for technical diagnosis. To this end, corresponding measurement values are recorded via the sensor units 4000, 5000 and relayed to a diagnostic module. The diagnostic module can be formed e.g., on the calculation unit 1000. For example, it is possible to monitor a leakage in the application. To this end, the sensors can be arranged in the valve, in the tubing, in the screw-connections and in the cylinder. During (first) start-up, an ACTUAL status is recorded which serves as a DESIRED status (equal to TARGET status) and as a (good) reference. During the run time of the application A, it is possible by triggering the diagnostic task to determine the leakage level at the respective positions of the valve assembly as an ACTUAL status, if the cylinder is located in a position permitting the recording of sensor data. After comparing between DESIRED status and ACTUAL status, the respective technical diagnostic information can be transmitted e.g., as a status bit (e.g., "leakage increased") to the calculation unit 1000 and/or to the electronic valve controller 1. The respective parameters of the DESIRED status can each be determined in a learning run of the pneumatic system.

In a further exemplified exemplary embodiment, application monitoring can be executed, in that e.g., a wear status of a pneumatic drive and/or a guide is to be determined. The breakaway pressure of the pneumatic drive and the run time between the end positions is recorded in the internal measurement signal unit 5000 taking into consideration the pressure level, the temperature and/or further parameters (previous movement etc.). This status is then stored as a DESIRED status and as a reference during start-up. During the run time, after triggering the monitoring task, the tribological state of the pneumatic drive (comprising status data with regard to the friction and wear of the components) can be ascertained when the cylinder is in its final position. Depending upon the recording of the ACTUAL status and the comparison with the DESIRED status, the result is transmitted as a status bit (e.g., "friction increased") to a monitoring entity, e.g., the calculation unit 1000.

In a further example, a valve status can be recorded by the recording of valve parameters at different positions in the valve disk VS, e.g.:

at the piezo-bender, at the internal part of the pilot cartridge, at the lower sides of the u-shaped electronics circuit board 120, at the inner front faces of the booster cartridges etc.

The DESIRED status is recorded by the manufacturer of the valve assembly and is stored as a reference. During the run time of the application A, by corresponding triggering of the monitoring task on the electronic valve controller 1 or on the calculation unit 1000 the system status of the valve or the valve disk VS can be determined and transmitted in a status bit (e.g., "check the valve").

Figure 6:
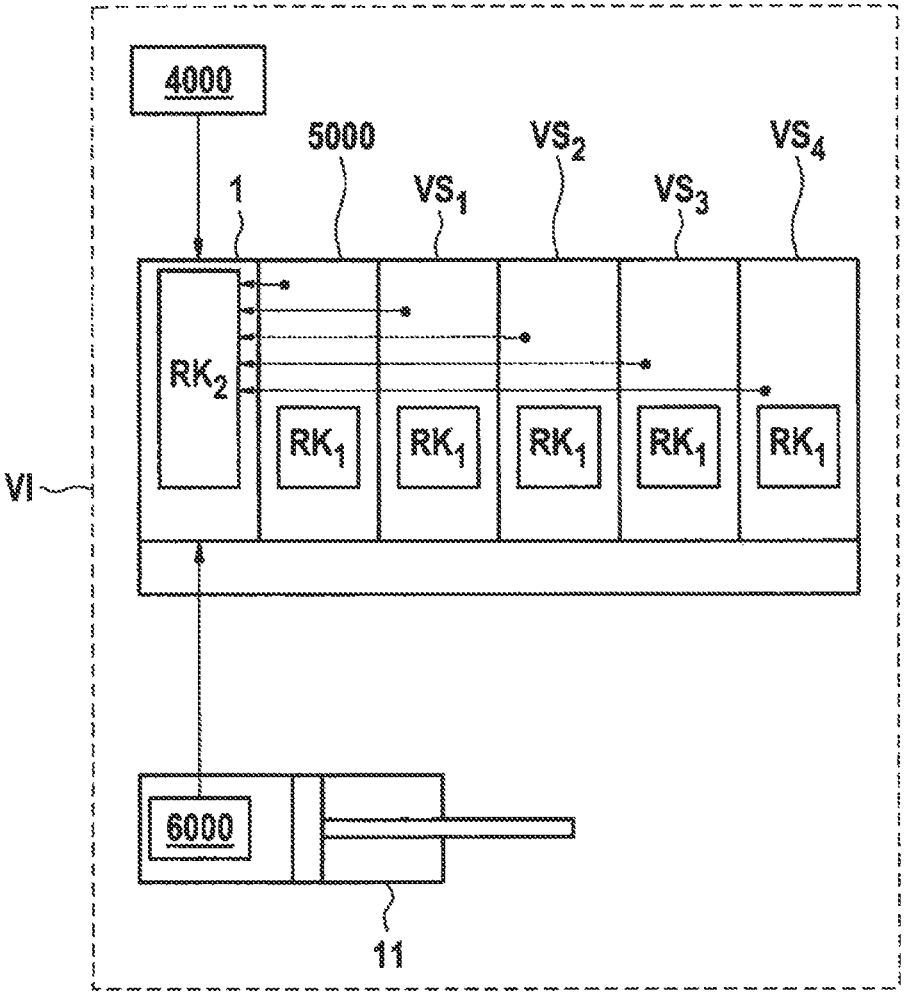
FIG. 6 shows a schematic view of different closed-loop circuits for controlling the valve assembly in a closed-loop manner.

FIG. 6 shows different closed-loop circuits which are used for the closed-loop control of the valve assembly. The valve island VI has the structure described in greater detail above and comprises four valve disks VS and an internal measurement signal unit 5000. Integrated on each valve disk VS is a first closed-loop circuit RK1 which calculates internal sensor signals (recorded locally on the valve disk VS) in order to control them in a closed-loop manner. Typically, the internal sensor signals of the piston-cylinder sensor unit 6000 are calculated for the first closed-loop circuit RK1 for the purpose of closed-loop control. In addition, the local measurement signals of the internal measurement signal unit 5000 can optionally also be calculated. A second closed-loop circuit RK2 is integrated in the electronic valve controller 1. It serves to calculate the sensor signals which are read-in by the internal measurement signal unit 5000 and the piston cylinder sensor unit 6000. According to one exemplary embodiment of the disclosure, the external sensor unit 4000 is connected in terms of data technology to the valve island VI, in particular to the electronic valve controller 1, so that the external sensor unit 4000 can send the process signals recorded thereon directly to the electronic valve controller 1 for the purpose of closed-loop control. In this case, the external process signals are also calculated locally on the electronic valve controller 1 in addition to the sensor signals of the internal measurement signal unit 5000 and the piston-cylinder sensor unit 6000, for the purpose of closed-loop control.

According to a typical exemplary embodiment of the disclosure and typically the movement task is recorded on the editor E and the application A is generated with the executable program code on the calculation unit 1000. The application A can then be distributed to one or a plurality of execution units for execution purposes. The execution units are digital entities or electronic components which are provided on a pneumatic valve or a valve assembly. The valve assembly can be the electronic valve controller 1 of a valve island VI and therefore a group of valve disks VS or the microcontroller 124 or another control unit of a valve disk VS. All of the modules of the pneumatic system exchange data so that a distributed solution can also be implemented.

Figure 7:
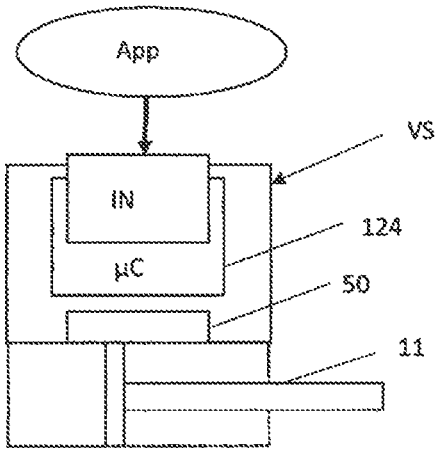
FIG. 7 shows an example of an exemplary embodiment of the disclosure, in which the valve disk for executing an application is arranged directly on a piston-cylinder assembly.

FIG. 7 shows an exemplified exemplary embodiment, in which the application A (also abbreviated as App in FIGS. 7 to 9) is read-in by a computer-based entity, e.g., a central server via an input interface IN on a valve disk VS. The input interface IN is typically integrated in the microcontroller 124 of the valve disks VS. The application A comprises open-loop control commands and/or closed-loop control commands in order to move a piston-cylinder assembly 11 according to the pneumatic movement task.

In the exemplary embodiment illustrated in FIG. 7, the valve disk VS is mounted directly on the piston-cylinder assembly 11. Corresponding pneumatic channels for operating the two chambers of the piston-cylinder assembly 11 and optionally also aeration and ventilation connections are provided. For the sake of simplicity, in the FIGS. these connections are combined as working connections 50 and are illustrated only schematically. The valve disk VS forms, together with the piston-cylinder assembly 11, an electro-pneumatic device.

An important advantage of this exemplary embodiment can be seen in the fact that no or, except for the functional fluid channels, no additional cabling has to be provided between the piston-cylinder assembly 11 with its components (sensors, signal recording units etc.) and the microcontroller 124.

Pressure signals which are recorded on the piston-cylinder assembly 11 via a pressure transducer are typically transmitted without any local pre-processing on the piston-cylinder assembly 11 directly to the microcontroller 124 for pre-processing and further processing. To this end, the microcontroller 124 can comprise an AD converter unit for converting the originally analogue signals into digital signals.

Likewise, other signal types, such as distance measurement signals or end position switch signals, which are detected on the piston-cylinder assembly 11, can be communicated directly without any local pre-processing to the microcontroller 124 for (pre-)processing therein. In this exemplary embodiment of the disclosure, the interface 50 is not unidirectional for communicating the valve control signals to the piston-cylinder assembly 11 but instead is bidirectional so that even analogue signals of the piston cylinder assembly 11 are transmitted back to the electronic execution unit, in particular to the microcontroller 124, for evaluation and processing purposes.

The above-depicted outsourcing of the pre-processing and processing of the signals of the piston-cylinder assembly 11 to the electronic execution unit can be configured not only in the design of the disclosure illustrated in FIG. 7 but also in the other exemplary embodiments of the disclosure described hereinafter in conjunction with FIG. 8 or 9.

Figure 8:
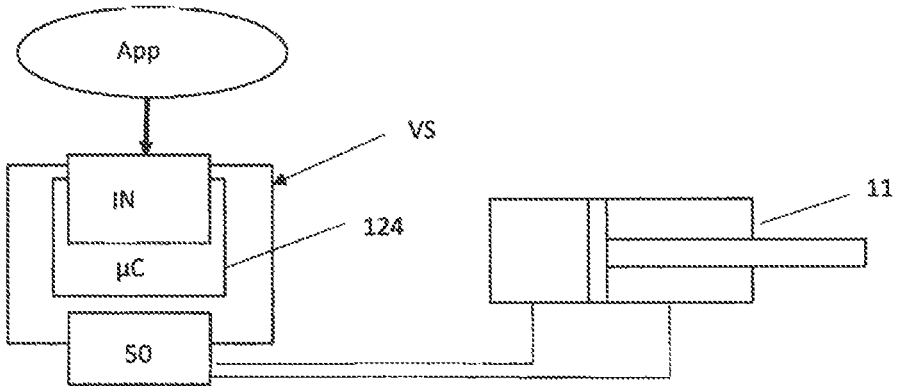
FIG. 8 shows a further example of an exemplary embodiment of the disclosure, in which the valve disk for executing an application is not arranged directly on a piston-cylinder assembly.

FIG. 8 illustrates an exemplary embodiment, in which the piston-cylinder assembly 11 is not located directly on the electropneumatic device—and thus on the valve disk VS—but instead is provided offset therefrom. The corresponding channels and connections between the valve disks VS and the piston-cylinder assembly 11 are provided.

Figure 9:
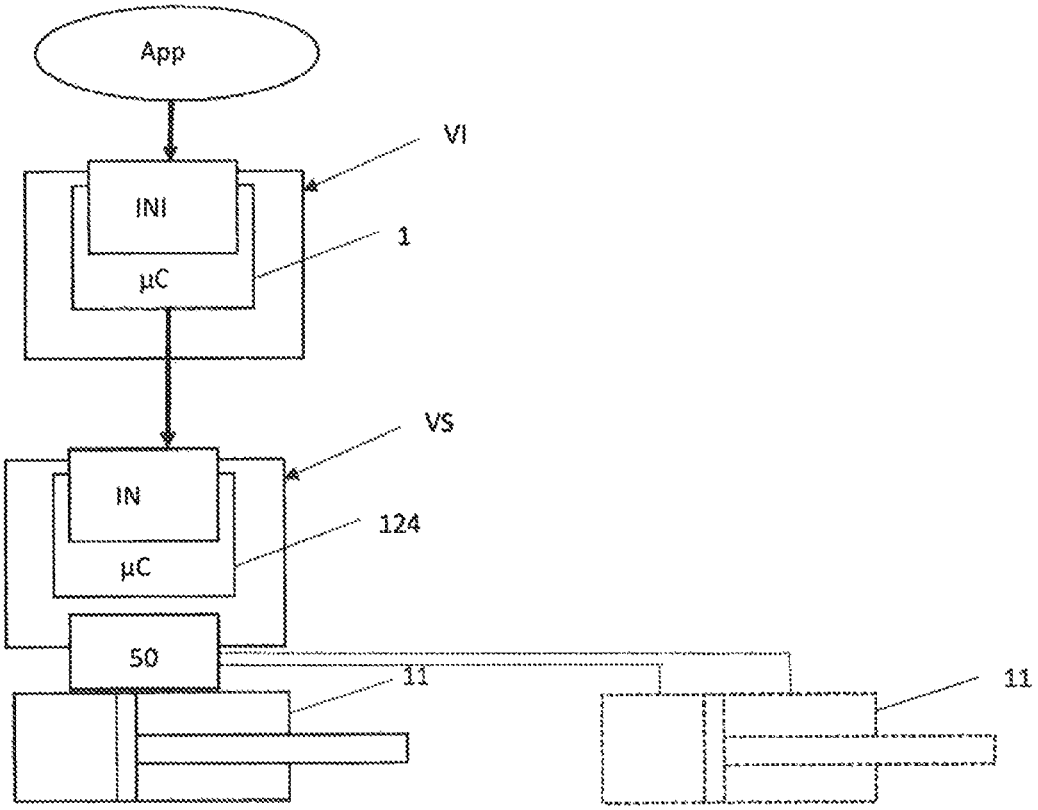
FIG. 9 describes an exemplary embodiment, in which a valve island is used as a passage station for relaying the application to a valve disk.

FIG. 9 shows a further variant, in which the application A is not loaded directly onto the valve disk VS but instead is initially loaded onto a valve island which then transfers the application A to the input interface IN of the valve disk. To this end, the valve island VI has the electronic valve controller 1 as a control unit which, for its part, comprises an input interface INI. This input interface INI is intended to record the application A from the server. In this exemplified exemplary embodiment, the application A is thus not implemented and executed directly on the valve island VI but instead is transferred by the valve island to a dedicated valve disk VS only for remote processing. As explained above in conjunction with FIGS. 7 and 8, the addressed valve disk VS may or may not be be arranged directly on the piston-cylinder assembly 11 (illustrated by the solid line in FIG. 9). In the case last referred to, corresponding connections are provided between the valve disk VS and the piston-cylinder assembly 11; in FIG. 9, this case is illustrated by the broken line and is intended to represent the alternative, indirect assembly.

Figure 10:
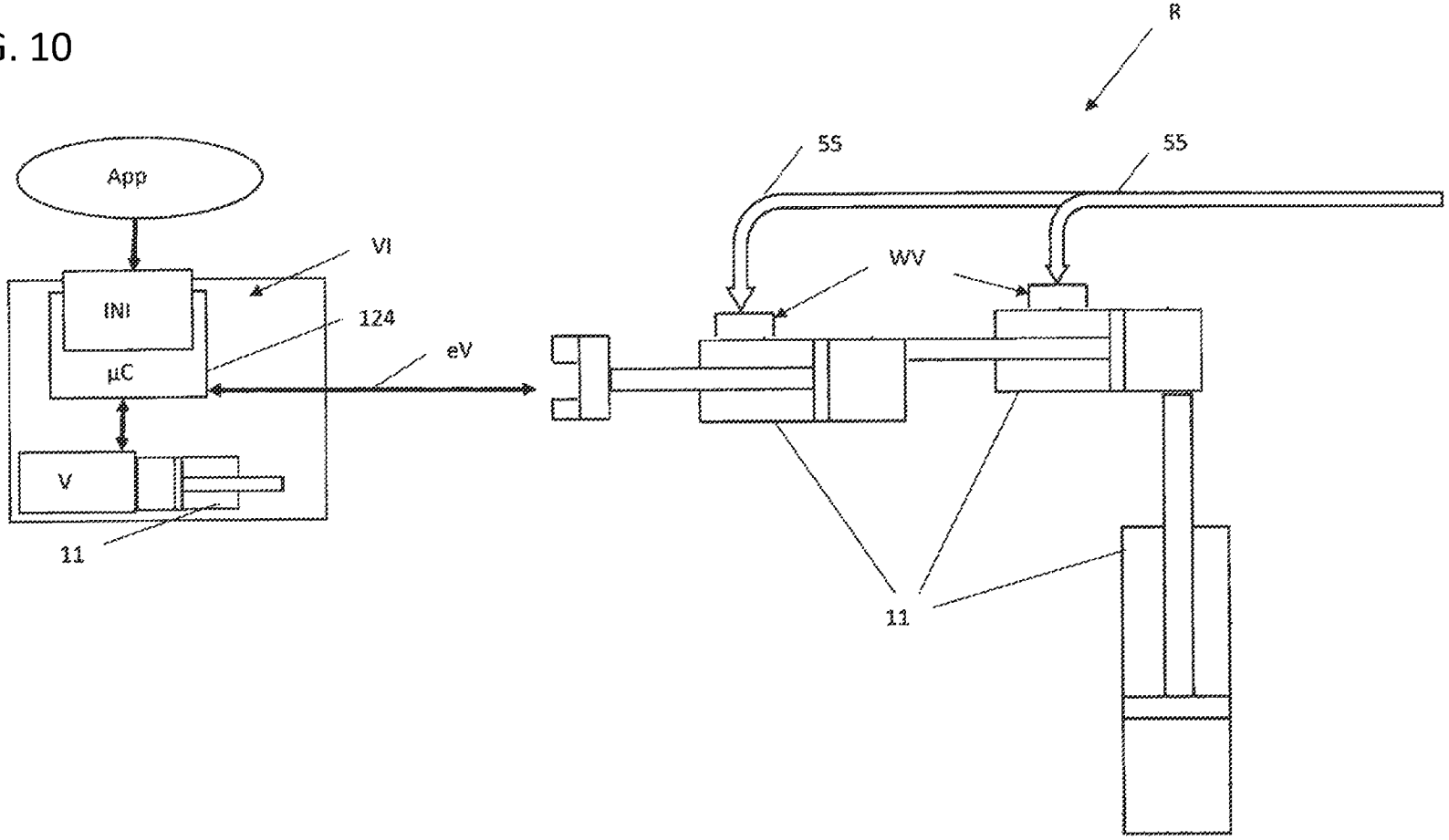
FIG. 10 shows schematically a further valve assembly which is offset from the valve island and is controlled in an open-loop manner and/or closed-loop manner thereby.

FIG. 10 schematically shows a further exemplary embodiment of the disclosure which resembles the design described in conjunction with FIG. 9 to the extent that the valve island VI is used only for transferring the received control App or control signals generated by means of the App. The control signals which are provided either directly by the application A or are calculated indirectly on the microcontroller μC of the valve island are relayed via a single data line, the electrical connection eV to a microcontroller of an offset drive element, in particular a robot arm R, on which further valves or further valve assemblies (e.g., valve disks) are arranged in order to move the drive elements of the robot arm R according to the movement task. The control signals are generated typically on the component on which the application A is loaded. Typically, this is the microcontroller μC 124, 1 of the valve island VI. The robot arm R indicated only schematically on the right-hand side of FIG. 10 is characterized by the fact that (except for the electrical data line eV) it is not connected to the valve VI or is positioned typically as a separate component at a different location than the valve island VI.

The further valve assembly WV can consist of only one valve V or can comprise a plurality of valves V or can also comprise at least one valve disk VS. The further valve assembly WV is supplied with pressure via a common pneumatic supply line 55. Typically, the pneumatic supply line 55 is not fed via a line which comes from the valve island VI. The pneumatic supply line 55 can be fed with a pre-configurable pressure, e.g., 6 bar, and the valves of the robot arm R can be fed by a separate source. Therefore, the valve island VI must be connected only via a single data line eV to the offset, separate robot arm R for transmission of the control data, which considerably reduces the outlay for the connection lines or tubing. In order to control the further valve assembly WV in an open-loop manner with the control data recorded via the line eV, a receiver must be formed on the robot arm R. It can be provided in the form of an electronic execution unit 124 (e.g., as a microcontroller) (for the sake of clarity, this is not illustrated in FIG. 10).

In other exemplary embodiments, the above-described designs can also be combined. Therefore, it is e.g., possible that the application A controls in an open-loop and/or closed loop manner a first movement task directly on the valve island VI and also a second movement task indirectly on further valves or further valve assemblies WV which are arranged on a movement unit separate from the valve island VI. In the example of FIG. 10, this is the robot arm R.

It is likewise within the scope of the disclosure to connect the further valve assembly WV to the valve island VI via a wireless interface. Then, the control signals of the application A, which are executed on the microcontroller of the valve island VI, can be transmitted wirelessly (e.g., via a wireless network, in particular WLAN of the IEEE802.11 family) to the further valve assembly WV. Likewise, the sensor data recorded locally on the valves of the further valve assembly WV can be transmitted wirelessly to the application e.g., for the purpose of closed-loop control. In this case, no cabling would be necessary between the valve island and the remote, separate further valve assembly.

Several advantages are associated with the disclosure. For instance, with the same construction (mechanical structure) of the valve disk VS and/or the valve island VI different valve functions can be activated (e.g., as a 4/2 or 4/3 directional control valve, with or without eco-mode, with or without soft stop or flow control etc.). On the other hand, the different valve functions and thus the different movement tasks can be controlled centrally on only one mask of a user interface. The user interface is provided typically on the calculation unit 1000 or alternatively on the control apparatus SPS. This makes operation and control clear and simple. Furthermore, closed-loop control can be executed during execution of the movement task both on the basis of internal closed-loop control variables of the valve island VI or the valve disk VS and on the basis of external closed-loop control variables (e.g., process signals outside the valve island VI). The closed-loop control can result directly in a new version (new parameterization) of the application A which is loaded in real time onto the execution units. A very rapid change of the movement task can also be performed without renewed parameterization. In order to control the movement task in an open-loop manner, in-depth knowledge of fluid technology is no longer required on account of the selection of different applications A.

Finally, it is noted that the description of the disclosure and the exemplified exemplary embodiments are fundamentally to be understood to be non-limiting with respect to a specific physical implementation of the disclosure. All features explained and illustrated in conjunction with individual exemplary embodiments of the disclosure can be provided in different combinations in the respective subject matter in accordance with the disclosure in order to achieve the advantageous effects thereof at the same time. In particular, it is obvious to a person skilled in the art that the disclosure can be applied not only to valve islands in the form described but also to other groups of components with valve assemblies or valve circuits which each comprise pneumatic valves. Furthermore, the components of the pneumatic movement control system can be distributed over a plurality of physical products. Therefore, in particular the editor E, the calculation unit 1000 and the at least one execution unit 1, 124, SPS of the valve assembly VS, VI can be provided on different structural units.

The scope of protection of the present disclosure is set by the claims and is not limited by the features explained in the description or shown in the drawings.

The foregoing description of the exemplary embodiments of the disclosure illustrates and describes the present invention. Additionally, the disclosure shows and describes only the exemplary embodiments, but, as mentioned above, it is to be understood that the disclosure is capable of being used in various other combinations, modifications, and environments and is capable of changes or modifications within the scope of the concept as expressed herein, commensurate with the above teachings and/or the skill or knowledge of the relevant art.

The term "comprising" (and its grammatical variations) as used herein is used in the inclusive sense of "having" or "including" and not in the exclusive sense of "consisting only of." The terms "a" and "the" as used herein are understood to encompass the plural as well as the singular.

All publications, patents, and patent applications cited in this specification are herein incorporated by reference, and for any and all purposes, as if each individual publication, patent, or patent application were specifically and individually indicated to be incorporated by reference. In the case of inconsistencies, the present disclosure will prevail.

REFERENCE SIGNS

VS valve disk
VS1 first valve disk
VS2 second valve disk, etc.
VI valve island
1 electronic valve controller
SPS memory-programmable control apparatus
10 base plate of the valve island
11 piston-cylinder assembly
12 ventilation facility
14 electrical connections
40 supply connection
50 working connection
100 housing for booster cartridges
112 booster cartridge
114 serial synchronous data bus
116 piezoactuator
118 valve
120 electronics circuit board
122 fastening element
124 microcontroller
E editor
MEM memory
1000 calculation unit
1002 interpreter
1004 memory containing application objects
1006 compositor
1008 matcher
1010 database containing license data
1020 distributor
1022 execution unit
2000 library of application objects
A application
3000 closed-loop control interface
4000 external sensor unit
5000 internal measurement signal unit
6000 piston-cylinder sensor unit
RK1 first closed-loop control circuit
RK2 second closed-loop control circuit
R robot arm
WV further valve assembly offset from the valve island
55 pneumatic supply line
eV electrical connection or connection line between the valve island and further valve assembly

The invention claimed is:

1. An electronic controller for at least one of an open-loop control or a closed-loop control of a pneumatic valve assembly for a pneumatic movement task, the electronic controller comprising:

a memory;

an input interface; and a processor in communication with the memory and the input interface, the processor being configured to:

load an application into the memory, the application being selected for the pneumatic movement task from a set of different applications for the open-loop control and the closed-loop control of the pneumatic movement task generated during a code generation phase prior to an execution phase, and each of the set of different applications representing a different movement task, wherein the application is generated by a self-learning system which generates different versions or parametrizations of the application for each different movement task based upon closed-loop control variables such that the pneumatic valve assembly can be controlled in an open-loop manner by the different versions or parametrizations of the application, and execute the application in at least one of an open-loop control manner or a closed-loop control manner to perform the pneumatic movement task on the pneumatic valve assembly.

2. The electronic controller as claimed in claim 1, wherein the electronic controller is a microcontroller, and wherein the valve assembly is a valve disk.

3. The electronic controller as claimed in claim 1, wherein the pneumatic valve assembly is arranged directly on a piston-cylinder assembly.

4. The electronic controller as claimed in claim 3, wherein the controller is in communication with a pressure transducer, and wherein the pressure transducer is configured to:

record pressure signals on the piston-cylinder assembly, and transmit the pressure signals directly and without any pre-processing to the electronic controller for pre-processing and processing.

5. The electronic controller as claimed in claim 4, wherein no electrical cabling is provided between the piston-cylinder assembly and the electronic controller.

6. The electronic controller as claimed in claim 1, wherein the pneumatic valve assembly is arranged at a distance from a piston-cylinder assembly, wherein the piston-cylinder assembly includes chambers, wherein the pneumatic valve assembly is in communication with the chambers via corresponding pneumatic channels to operate the chambers of the piston-cylinder assembly.

7. The electronic controller as claimed in claim 1, further comprising:

an input interface configured to read-in the application, and an output interface configured as a working connection to move the piston-cylinder assembly.

8. The electronic controller as claimed in claim 1, wherein the input interface of the electronic controller is configured to read-in the application and to receive the application from an electronic valve controller of a valve island.

9. The electronic controller as claimed in claim 1, wherein the electronic controller implements the application and is arranged on a valve island to directly control valves in the open-loop control or the closed-loop control, the valves being arranged at least at one of locally on the valve island or to indirectly control a further valve assembly in the open-loop control or the closed-loop control, the further valve assembly being arranged on an offset drive element to execute the respective pneumatic movement task.

10. The electronic controller as claimed in claim 9, wherein during at least one of an indirect open-loop control or an indirect closed-loop control of the further valve assembly by the application on the offset drive element only one electrical connection is provided between the valve island and the further valve assembly, and wherein all of the valves of the further valve assembly are supplied via a common pneumatic supply line.

11. The electronic controller as claimed in claim 10, wherein the pneumatic supply line of the valves of the further valve assembly extends separately from the electrical connection.

12. The electronic controller as claimed in claim 1, wherein the electronic controller is arranged on a component other than the one on which the pneumatic movement task is to be executed.

13. The electronic controller as claimed in claim 1, wherein the pneumatic valve assembly is controlled in the closed-loop control on a basis of internal sensor signals, which are recorded by sensors arranged on the pneumatic valve assembly or arranged remotely on the further valve assembly.

14. A valve assembly being controlled in an open-loop manner or in a closed-loop manner by the electronic controller as claimed in claim 1.

15. The electronic controller as claimed in claim 13, wherein the electrical connection transmits sensor data, which have been recorded on the further valve assembly and are transmitted to the application for the closed-loop control.

16. An electropneumatic system comprising:

at least two controllers, wherein a first controller is configured as an electronic valve controller of a valve island and a second controller is configured as a microcontroller of a valve disk, wherein an application is received on the first electronic valve controller and is transferred to the microcontroller, wherein the application is selected for the pneumatic movement task from a set of different applications for the open-loop control and the closed-loop control of a pneumatic movement task generated during a code generation phase prior to an execution phase, wherein each of the set of different applications represents a different movement task, wherein the application is generated by a self-learning system which generates different versions or parametrizations of the application for each different movement task based upon closed-loop control variables such that the pneumatic valve assembly can be controlled in an open-loop manner by the different versions or parametrizations of the application, and wherein the electronic valve controller controls the valve disk in at least one of an open-loop control or a closed-loop control to execute the pneumatic movement task on a piston-cylinder assembly.

17. The electropneumatic system as claimed in claim 16, wherein the communication connection between the valve disk and the valve island is configured as a point-to-point communication channel, as a point-to-point communication channel with protocol drivers, or as a bus system.

18. An electronic valve controller for at least one of an open-loop control or a closed loop control of a pneumatic valve assembly for a pneumatic movement task, the electronic valve controller comprising:

a memory;

an input interface; and a processor in communication with the memory and the input interface, the processor being configured to:

load an application into the memory, the application being selected for the pneumatic movement task from a set of different applications for the open-loop control and the closed-loop control of the pneumatic movement task generated during a code generation phase prior to an execution phase, and each of the set of different applications representing a different movement task, wherein the application is generated by a self-learning system which generates different versions or parametrizations of the application for each different movement task based upon closed-loop control variables such that the pneumatic valve assembly can be controlled in an open-loop manner by the different versions or parametrizations of the application, and, execute the application for the at least one of the open-loop control or the closed-loop control of the valve assembly to perform the pneumatic movement task.

19. The electronic valve controller as claimed in claim 18, further comprising:

a plurality of valve disks, wherein each valve disk includes four or eight connected pneumatic valves.

20. The electronic valve controller as claimed in claim 18, wherein the electronic valve controller exchanges data with a processor via an interface, and wherein the processor generates the application based on a movement task input via an editor.

21. The electronic valve controller as claimed in claim 18, wherein the electronic valve controller and an internal measurement signal unit are arranged on a valve island, and wherein the electronic valve controller receives local measurement signals of the valve assembly via the internal measurement signal unit and calculates control signals for the closed-loop control.

22. The electronic valve controller as claimed in claim 18, wherein the electronic valve controller controls the valve assembly in the open-loop control or the closed loop control to move a piston-cylinder assembly, wherein the piston-cylinder assembly includes a piston-cylinder sensor unit configured to detect internal sensor signals, and wherein the electronic valve controller calculates the detected internal measurement signals for the closed-loop control.

23. The electronic valve controller as claimed in claim 18, wherein the electronic valve controller modifies and parameterizes the application based on at least one of local measurement signals of the valve assembly recorded on the internal measurement signal unit, internal sensor signals of a piston-cylinder sensor unit, or external process signals of an external sensor unit.

24. The electronic valve controller as claimed in claim 18 further comprising:

a first closed-loop circuit implemented in each case in a valve disk of a valve island and configured to calculate sensor signals of the valve disk; and a second closed-loop circuit integrated in the electronic valve controller and configured to calculate at least one of internal sensor signals of a piston-cylinder sensor unit, local measurement signals of an internal measurement signal unit, or external process signals of an external sensor unit for the closed-loop control.

25. The electronic valve controller as claimed in claim 18, wherein the electronic valve controller exchanges data with a digital programmable control apparatus via a bus system, and wherein the application loaded onto the electronic valve controller is incorporated into a sequence program on the digital programmable control apparatus to permit execution of the application to be triggered on the valve assembly via the digital programmable control apparatus.

26. The electronic valve controller as claimed in claim 18, wherein the electronic valve controller exchanges data with a digital programmable control apparatus via a bus system, and the digital programmable control apparatus is provided with further control applications which can be loaded onto the electronic valve controller to execute the pneumatic movement task.

27. A method for at least one of an open-loop control or a closed-loop control of a pneumatic valve assembly for executing a pneumatic movement task, the method comprising:

recording the pneumatic movement task;

automatically generating an executable program code for the at least one of the open-loop control or the closed-loop control of the pneumatic valve assembly based on the recorded pneumatic movement task with access to a library of application objects; and loading the executable program code as an application in real time on controllers of the valve assembly, wherein the application is automatically generated as a part of a set of different applications for the open-loop control and the closed-loop control of the pneumatic movement task generated during a code generation phase prior to an execution phase, wherein each of the set of different applications represents a different movement task, and wherein the application is generated by a self-learning system which generates different versions or parametrizations of the application for each different movement task based upon closed-loop control variables such that the pneumatic valve assembly can be controlled in an open-loop manner by the different versions or parametrizations of the application.

28. The method as claimed in claim 27, wherein, during execution of the movement task by the valve assembly, at least two closed-loop circuits are controlled by the closed-loop control of the valve assembly, including:

a first closed-loop circuit which is implemented in each case in a valve disk of a valve island and calculates sensor signals of the valve disk; and a second closed-loop circuit which is integrated in the electronic valve controller and calculates sensor signals of at least one of a piston-cylinder sensor unit, an internal sensor unit, or an external sensor unit.

29. The method as claimed in claim 27, wherein the closed-loop control comprises automatically determining target values for at least one of sensor signals, measurement signals, or external process signals.

30. The method as claimed in claim 27, wherein the closed-loop control of the valve assembly is effected in real time.

31. The method as claimed in claim 27, wherein the application is parameterized and target parameter values are calculated for parameterizing the application.

32. The method as claimed in claim 27, wherein for the open-loop control or the closed-loop control at least one of the following operating conditions is specified, based on which the executable program code is generated:

damping a piston movement by providing a damping function, controlling a speed of a piston in a closed-loop control by providing a throttle function for controlling the piston speed in the closed-loop control, providing a pressure control and/or pressure progression control, controlling an executing time of the movement task in the closed-loop control, controlling an energy efficiency of the movement task in the closed-loop control, executing a movement with at least one of intermediate stops or separate movement sections, closed-loop control with regard to application-specific parameters to be determined, performing the movement task for the purpose of diagnosis, or open-loop control of flow or mass flow of the valves.

33. The method as claimed in claim 27, wherein at least one of local measurement signals of an internal measurement signal unit, internal sensor signals of a piston-cylinder sensor unit, or external process signals of an external sensor unit are calculated for the closed-loop control of the valve assembly.

34. A pneumatic movement control system for at least one of an open-loop control or a closed-loop control of a pneumatic valve assembly for executing a pneumatic movement task, the pneumatic movement control system comprising:

an editor configured as a user interface for recording the pneumatic movement task;

a processor configured to generate, based on the recorded pneumatic movement task, an executable program code, which is provided as an application, wherein the application is generated as a part of a set of different applications for an open-loop control and a closed-loop control of the pneumatic movement task generated during a code generation phase prior to an execution phase, wherein each of the set of different applications represents a different movement task, and wherein the application is generated by a self-learning system which generates different versions or parametrizations of the application for each different movement task based upon closed-loop control variables such that the pneumatic valve assembly can be controlled in an open-loop manner by the different versions or parametrizations of the application; and at least one electronic controller of the valve assembly which in each case is configured to read-in the application and execute the application to control the valve assembly in at least one of the open-loop control according to the movement task or the closed-loop control based on internal closed-loop control variables and external process signals.

35. The pneumatic movement control system as claimed in claim 34, wherein the processor is further configured to:

separate the recorded movement task into a series of tasks;

access a memory comprising stored application objects to select, for each task, the application objects necessary for a respective task from a total set of all provided application objects to generate an executable program code therefrom;

distribute the generated executable program code to at least one electronic controller and load it on the at least one electronic controller; and execute the generated executable program code, which is optionally configured to record internal measurement signals as closed-loop control variables and to return the recorded internal measurement signals to the processor to generate a modified executable program code.

36. The pneumatic movement control system as claimed in claim 34, wherein the processor is further configured to:

access an external memory storing a library of application objects requiring a license, optimize generating the executable program code based on pre-definable optimization criteria by analyzing whether application objects requiring a license exist in the external memory, which are provided for executing the recorded movement task taking into consideration internal and external closed-loop control variables, and in case of affirmation a license key for the application objects requiring the license is checked in the license memory, access the application objects requiring the license of the external memory to be downloaded and accessed.

* * * * *